US007399403B2

(12) United States Patent
Garcia, III et al.

(10) Patent No.: US 7,399,403 B2
(45) Date of Patent: Jul. 15, 2008

(54) DECALCIFICATION OF REFINERY HYDROCARBON FEEDSTOCKS

(75) Inventors: Juan M. Garcia, III, Sugar Land, TX (US); Michel L. Braden, Sugar Land, TX (US)

(73) Assignee: Nalco Company, Naperville, IL (US)

( * ) Notice: Subject to any disclaimer, the term of this patent is extended or adjusted under 35 U.S.C. 154(b) by 294 days.

(21) Appl. No.: 10/837,806

(22) Filed: May 3, 2004

(65) Prior Publication Data

US 2005/0241996 A1 Nov. 3, 2005

(51) Int. Cl.
*C10G 17/00* (2006.01)

(52) U.S. Cl. ..... 208/251 R; 208/252; 208/253

(58) Field of Classification Search ..... 208/251 R, 208/252, 253
See application file for complete search history.

(56) References Cited

U.S. PATENT DOCUMENTS 4,541,918 A * 9/1985 Stapp ..... 208/87
5,660,717 A * 8/1997 Lindemuth ..... 208/251 R
6,103,100 A * 8/2000 Hart ..... 208/47

* cited by examiner

*Primary Examiner*—Tam M Nguyen
(74) *Attorney, Agent, or Firm*—Michael B. Martin

(57) ABSTRACT

A process for removing metal contaminants, particularly calcium, from hydrocarbon feedstocks is disclosed. The process comprises mixing the feedstocks with an effective metal removing amount of an aqueous solution of one or more water-soluble poly(acrylic acid) derivatives to form an aqueous phase containing the metal ions and a hydrocarbon phase and separating the hydrocarbon phase from the aqueous phase.

11 Claims, No Drawings

DECALCIFICATION OF REFINERY HYDROCARBON FEEDSTOCKS

TECHNICAL FIELD

The present invention relates to a process to remove certain organically bound metal ions from crude oil, especially calcium, using water-soluble poly(acrylic acid) derivatives.

BACKGROUND OF THE INVENTION

Basic metals such as calcium, when present in crude oil can lead to fouling of heaters and heat exchangers and poison catalysts used in crude processing. When present as inorganic salts, e.g., chlorides, usually in an oil-encapsulated water phase, the salts can hydrolyze to release corrosive mineral acids. Refinery desalters customarily remove such salts. However, oil-soluble metal salts such as naphthenates and phenolates are not removed by conventional desalting. Therefore, oil-soluble, basic metal-rich crudes are less valuable than crudes with low levels of such metals. A process for metal ion removal enables the increase of the value of such crudes.

A few, but increasingly important, petroleum crude feedstocks, residua, and deasphalted oil derived from them, contain levels of calcium or iron which render them difficult, if not impossible, to process using conventional refining techniques. The metals contaminants causing particular problems are in the form of nonporphyrin, organometallically bound compounds. These species have been attributed to either naturally occurring calcium complexes or solubilized calcium from recovery waters that comes in contact with crude oils. One possible class of calcium compounds identified in particular is the respective naphthenates and their homologous series. These organometallic compounds are not separated from the feedstock by normal desalting processes, and in a conventional refining technique they can cause the very rapid deactivation of hydroprocessing catalysts. Examples of feedstocks demonstrating objectionably high levels of calcium compounds are crudes from China such as Shengli No. 2; DOBA from West Africa; Gryphon and Harding crude oil from the North Sea; and SJV from the West Coast of USA.

Accordingly, there is an ongoing need for the development of new technologies for the effective removal of metal contaminants, particularly calcium, from hydrocarbon feedstocks.

SUMMARY OF THE INVENTION

This invention is a method of removing metal ions from hydrocarbon feedstocks comprising (i) mixing the feedstocks with an effective metal removing amount of an aqueous solution of one or more water-soluble poly(acrylic acid) derivatives to form an aqueous phase containing the metal ions and a hydrocarbon phase; and (ii) separating the hydrocarbon phase from the aqueous phase.

The polyacrylic acid derivatives are non-volatile, odorless and are non-hazardous by DOT regulations. The polymers exhibit a high degree of specificity for calcium and iron contaminants and will not chelate zinc unless high dosages are employed. The polymers are readily precipitated by inorganic or organic polyelectrolytes and/or blends of inorganic/organic polyelectrolytes, allowing for removal of any polymer-metal complexes by the primary wastewater treatment plant (WWTP). As the polymer is removed at the primary WWTP it will not impair or decrease the efficiency of the secondary or biological treatment system.

DETAILED DESCRIPTION OF THE INVENTION

Poly(acrylic acid) derivatives suitable for removing metal ions from hydrocarbon feedstocks according to the method of this invention include water-soluble polymers comprising at least about 50 mole percent of monomer units derived from (meth)acrylic acid and its salts. As used herein, (meth)acrylic acid means acrylic acid or methacrylic acid. Salts include the sodium, potassium and ammonium salts.

The polyacrylic acid derivatives may be prepared by polymerizing (meth)acrylic acid or a salt thereof and optionally one or more cationic, anionic or nonionic monomers under free radical forming conditions using conventional gel, solution, emulsion or dispersion polymerization techniques. As used herein, (meth)acrylic acid means acrylic acid or methacrylic acid.

Representative non-ionic, water-soluble monomers include acrylamide, methacrylamide, N,N-dimethylacrylamide, N,N-diethylacrylamide, N-isopropylacrylamide, N-vinylformamide, N-vinylmethylacetamide, N-vinyl pyrrolidone, hydroxyethyl methacrylate, hydroxyethyl acrylate, hydroxypropyl acrylate, hydroxypropyl methacrylate, N-t-butylacrylamide, N-methylolacrylamide, vinyl acetate, vinyl alcohol, and the like. Preferred nonionic monomers are acrylamide and methacrylamide.

Representative anionic monomers include acrylic acid, and it's salts, including, but not limited to sodium acrylate, and ammonium acrylate, methacrylic acid, and it's salts, including, but not limited to sodium methacrylate, and ammonium methacrylate, 2-acrylamido-2-methylpropanesulfonic acid (AMPS), the sodium salt of AMPS, sodium vinyl sulfonate, styrene sulfonate, maleic acid, and it's salts, including, but not limited to the sodium salt, and ammonium salt, sulfonate, itaconate, sulfopropyl acrylate or methacrylate or other water-soluble forms of these or other polymerisable carboxylic or sulphonic acids. Sulfomethylated acrylamide, allyl sulfonate, sodium vinyl sulfonate, itaconic acid, acrylamidomethylbutanoic acid, fumaric acid, vinylphosphonic acid, vinylsulfonic acid, allylphosphonic acid, sulfomethylated acrylamide, phosphonomethylated acrylamide, itaconic anhydride, and the like.

Representative cationic monomers include allyl amine, vinyl amine, dialkylaminoalkyl acrylates and methacrylates and their quaternary or acid salts, including, but not limited to, dimethylaminoethyl acrylate methyl chloride quaternary salt (DMAEA•MCQ), dimethylaminoethyl acrylate methyl sulfate quaternary salt, dimethyaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, dialkylaminoalkylacrylamides or methacrylamides and their quaternary or acid salts such as acrylamidopropyltrimethylammonium chloride, dimethylaminopropyl acrylamide methyl sulfate quaternary salt, dimethylaminopropyl acrylamide sulfuric acid salt, dimethylaminopropyl acrylamide hydrochloric acid salt, methacrylamidopropyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethylaminoethylmethacrylate, diallyldiethylammonium chloride and diallyldimethyl ammonium chloride (DADMAC). Alkyl groups are generally $C_{1-4}$ alkyl.

The poly(acrylic acid) derivatives may also be prepared by functionalization of preformed (meth)acrylic acid polymers. For example, (meth)acrylic acid polymers prepared as described above may be sulfomethylated as described in U.S. Pat. No. 4,795,789, incorporated herein by reference. Sulfonated (meth)acrylic acid polymers may also be prepared by transamidation of (meth)acrylic acid polymers containing pendant amido groups with amines containing at least one sulfonate group as described in U.S. Pat. No. 4,703,092, incorporated herein by reference.

(Meth)acrylic acid polymers containing pendant amido groups can be prepared by direct amidation of the carboxyl groups of the (meth)acrylamide polymer with amines such as monoethanolaminde, dimethylamine, and the like under acidic or basic conditions or transamidation of copolymers containing carboxylic acid and (meth)acrylamide units as described in U.S. Pat. No. 4,919,821, incorporated herein by reference.

In a preferred aspect of this invention, the poly(acrylic acid) derivative has a molecular weight of about 100 to about 4,000,000. Molecular weights reported herein are weight average molecular weights.

In another preferred aspect, the poly(acrylic acid) derivative is selected from sulfomethylated poly(meth)acrylic acid and salts thereof, poly((meth)acrylic acid) and salts thereof and polymers of (meth)acrylic acid or a salt thereof and one or more monomers selected from (meth)acrylamide, dimethylaminoethylacrylate quaternary salt, diallyldimethylammonium chloride and 2-acrylamido-2-methylpropanesulfonic acid or a salt thereof.

In another preferred aspect, the polyacrylic acid derivative acrylic acid-dimethylaminoethylacrylate methyl chloride quaternary salt copolymer.

In another preferred aspect, the poly(acrylic acid) derivative is selected from poly(acrylic acid) and salts thereof.

In another preferred aspect, the poly(acrylic acid) derivative has a molecular weight of about 2,000 to about 8,000.

The polyacrylic acid derivatives described herein are effective for removing a variety of +2 and +3 ionically charged metals from crude, residuum and deasphalted oil. Representative metals include +2 and +3 ionically charged metals are selected from zinc, iron, cobalt, copper, magnesium, manganese and calcium.

In a preferred aspect of this invention, the ionically charged metals are selected from the group consisting of +2 ionically charged metals.

In another preferred aspect, the +2 ionically charged metal is calcium.

To remove metal ions, the crude, residuum or deasphalted oil to be processed is simply mixed with an aqueous solution of the poly(acrylic acid) derivative. The metal ions are readily bound or chelated to the pendant carboxylic acid groups of the poly(acrylic acid) derivative to form a complex. This metal-poly(acrylic acid) complex is ionic and water soluble, and is therefore extracted into the aqueous phase of the mixture. The two phases, the aqueous and the crude or hydrocarbonaceous phase, are separated or permitted to separate. The aqueous solution containing the metal contaminant is removed, resulting in a hydrocarbon feed with removed metals, which then can be handled in the same manner as any other carbonaceous feed and processed by conventional hydroprocessing techniques. It is contemplated that the physical separation process is ordinarily to be done in a conventional crude desalter, which is usually used for desalting petroleum crudes prior to hydroprocessing. The separation may be done by any separation process, however, and may include countercurrent extraction.

The ratio of poly(acrylic acid) derivative to hydrocarbonaceous feed should be empirically optimized, with the determining factor being the separation method. Commercial desalters, for example, ordinarily run at 10% or less aqueous volume.

The contact time between the aqueous extraction solution and the hydrocarbonaceous feed is important, and may vary from between less than a few seconds to about 4 hours. The preferred contact time is from about one second to about one hour.

In a preferred aspect, the poly(acrylic acid) derivative is injected into the desalter wash water prior to blending of this wash water with the incoming crude oil. This mixture is then passed through a high shear valve to obtain thorough contact of the water with the oil. This process is called "desalting" and is literally removing water soluble chloride salts from the oil. The chloride salts are present due to the water found in the incoming crude oil. Essentially, the salt concentration is diluted by the addition of the wash water. The wash water is treated with demulsifiers to help the oil/water separation. Any water remaining with the oil effluent from the desalter will have low salt values. Temperatures in the desalter typically range from about 200 to about 325° F.

To remove metals such as calcium in the desalter, the poly(acrylic acid) derivative is added continuously to the wash water. With the vigorous mixing of the oil and water, the poly(acrylic acid) derivative chelates the calcium. This polymer and the polymer-calcium complex are water-soluble, therefore, the calcium is removed via the water phase. The polymer dosage generally ranges from about 0.25 to about 1.5 weight percent in the desalter wash water. This equates to about 2-15 ppm of poly(acrylic acid) derivative to one ppm of calcium, preferably about four to about ten ppm of poly (acrylic acid) derivative to one ppm of calcium.

The foregoing may be better understood by reference to the following examples, which are presented for purposes of illustration and are not intended to limit the scope of this invention.

EXAMPLE 1

Chemical Comparison of Polyacrylic Acid and Acetic Acid.

Polyacrylic acid is a water-soluble organic polymer designed to remove certain organically bound metal ions from crude oil. The polyacrylic acid used in the following examples is a clear, odorless, colorless liquid, 35% actives, with a specific gravity of 1.26, pH of 3, and a Brookfield viscosity of 275 cps at 70° F. The freeze point is >−50° F. For shipment, polyacrylic acid has a Flash Point of >200° F. (non-volatile) and is labeled a non-hazardous material. The poly(acrylic acid) is available from Nalco Company, Naperville, Ill.

The current state-of-the-art chemical used in this application is glacial acetic acid at 100% actives. This is a clear, colorless liquid with an acidic or vinegar odor. The specific gravity is 1.051, pH 4.5 and a Brookfield viscosity of <50 cps at 70° F. The freeze point is <61.9° F. (<16.6° C.). For shipment, glacial acetic acid has a Flash Point of 109° F. (volatile) and is labeled hazardous as combustible and corrosive. The molecular weight of acetic acid is 60.05.

The volatility difference is quite significant. Acetic acid has the potential to increase corrosion rates in the overhead of the crude distillation unit. Acetic acid in the overhead will increase the use of chemical neutralizing agents and shorten the life span of the metallurgy. The poly(acrylic acid) derivatives are not as volatile and will not increase corrosion rates, consume additional chemical neutralizing agents nor affect the metallurgy.

EXAMPLE 2

Polyacrylic Acid Vs. Acetic Acid in Calcium Removal.

The removal of calcium from KOME 98 crude oil using polyacrylic acid (PAA) versus the current state-of-the-art glacial acetic acid (GAA) is shown in Table 1. The results are expressed in mole ratios to provide a greater understanding due to the differences in the concentration of the products (100% GAA vs. 35% for PAA). Furthermore, the PAA is expressed in moles of carboxylic acid groups. This will allow for more meaningful results, since GAA is a one carboxylic acid unit whereas PAA contains an average of 69.38 carboxylic acid units. Therefore, the number of moles of carboxylic acid units is calculated for each dosage and the results are tabulated in Table 1 below.

As shown in Table 1, PAA removes a greater amount of calcium based on mole ratios. To achieve a 97% removal rate, GAA needs a mole ratio of 3.50 moles GAA to moles calcium compared to 0.024 for acid groups in PAA. Also, Table 1 shows that increasing the amount of GAA does not improve the calcium removal rate. For PAA, as the number of carboxylic acid moles increase, the percentage of calcium removed also increases.

TABLE 1

Calcium Removal from KOME 98 Crude Oil using Polyacrylic Acid or Acetic Acid

| Wt. % Solution | Mole Ratio GAA to Ca | Ca (ppm) in oil phase | Percent Ca Removal | Mole Ratio of Acid Groups in PAA to Ca[1] | Ca (ppm) in oil phase | Percent Ca Removal |
|---|---|---|---|---|---|---|
| 0.00 | 0.00 | 150.00 | 0.0 | 0.00 | 150.00 | 0.0 |
| 0.25 | 1.16 | 62 | 58.7 | 0.006 | 120 | 20.0 |
| 0.50 | 2.32 | 9.3 | 93.8 | 0.012 | 85 | 43.3 |
| 0.75 | 3.48 | 15 | 90.0 | 0.018 | 56 | 62.6 |
| 1.00 | 4.64 | 14 | 90.7 | 0.024 | 28 | 81.3 |
| 1.25 | 5.79 | 21 | 86.0 | 0.029 | 6.3 | 95.8 |
| 0.00 | 0.00 | 180.00 | 0.00 | 0.000 | 180.00 | 0.00 |
| 0.75 | 3.48 | 6.9 | 96.2 | 0.015 | 62 | 65.6 |
| 1.00 | 4.64 | 1.8 | 99.0 | 0.019 | 32 | 82.2 |
| 1.25 | 5.79 | 7.5 | 95.8 | 0.024 | 4.8 | 97.3 |
| 1.50 | 6.95 | 5.6 | 96.9 | 0.029 | 0.9 | 99.5 |

[1]number of moles of acid groups in 1 mole of polyacrylic acid is 69.38 (5000 g/mol polymer divided by 72.064 g/mol acrylic acid)

EXAMPLE 3

Polyacrylic Acid Vs. Acetic Acid in Zinc Removal.

As the poly(acrylic acid) derivatives interact with the hydrocarbon feedstocks, the materials have the ability to remove other +2 valance metals ion as well, such as, zinc, iron, nickel, magnesium, manganese, etc. that are associated with the hydrocarbon phase. In particular, zinc is of immediate importance. If zinc levels are greater than 1 ppm, action must be taken to remove zinc from the desalter wash water. As shown in Table 2, polyacrylic acid concentrations of less than 1.15 weight percent complexes less than 1 ppm zinc in the wastewater. In comparison to the state-of-the-art program of glacial acetic acid, concentrations of greater than 0.25 weight percent complexes more than 1 ppm of zinc into the desalter wash water.

TABLE 2

Zinc concentration in Desalter Wash Water

| Wt. Percent | Zinc, ppm | |
|---|---|---|
| Solution | Glacial Acetic Acid | Polyacrylic Acid |
| 0.00 | <0.5 | <0.5 |
| 0.25 | <0.5 | |
| 0.50 | 7.5 | |
| 0.75 | 12 | <0.5 |
| 0.95 | | <0.5 |
| 1.00 | 14 | 0.5 |
| 1.05 | | 0.73 |
| 1.10 | | 0.77 |
| 1.15 | | 0.89 |
| 1.25 | 15 | 2.1 |
| 1.50 | 15 | 5.8 |

As discussed below, inorganic and organic polyelectrolytes can complex and precipitate poly(acrylic acid) derivatives. These polyelectrolytes may complex glacial acetic acid, but this complex is water-soluble and will not precipitate. Thus the acetic acid will pass to the secondary or biological treatment process. With regard to zinc, the polyacrylic acid-zinc complex will be precipitated and removed prior to the biological system. It will not be necessary to utilize special treatment facilities to handle the heavy metals in the wastewater as is required when acetic acid is used as the calcium complexing agent. The acetic acid-zinc complex is difficult to precipitate and will pass to the secondary or biological treatment process. Zinc will inhibit the bacteria from removing the organic or inorganic contaminants in the water. Thus, it must be removed prior to the biological treatment process.

EXAMPLE 4

Polyacrylic Acid and Acetic Acid Comparison in the Primary and Secondary (Biological) Treatment Plants.

Poly(acrylic acid) derivatives are water-soluble and will go with the water wash used in desalting applications. Downstream operations receive the water wash in the primary wastewater treatment plant (WWTP). This polymer can be removed by using typical inorganic chemicals or organic polymers and/or blends of inorganic and organic chemicals used in the primary wastewater treatment plants. The removal of this polymer from the water allows the biological or secondary wastewater treatment system to remove other water-soluble organic hydrocarbons, such as phenols, cyanides, methanol, ethanol, and any water-insoluble hydrocarbons as well as some water-soluble inorganic materials (ammonia, for example) that were not removed by the primary WWTP.

Acetic acid is water-soluble, but due to the low molecular weight of the chemical, the primary WWTP cannot remove this material with chemical additives; therefore, the biological or secondary WWTP must remove the acetic acid. The biological treatment plant will have the following difficulties:

1. Since the acetic acid molecules are small, the bacteria will consume acetic acid in preference to the other organic/inorganic contaminants in the wastewater. Thus the oil in the effluent increases, potentially leading to violations and fines if the increase is above the maximum allowable levels.
2. This increase in food source will affect the bacteria population yielding a much younger population. This decrease in the age of the bacteria population will inhibit settling in the secondary clarifier and increase total suspended solids (TSS) in the effluent.
3. The young bacteria population will have a negative effect on the sludge dewatering application making it more difficult to remove water from the biological sludge.
4. Finally, the young bacteria population is readily susceptible to upsets. Short-term high concentrations of hydrocarbons, ammonia, amines, etc. coming to the secondary WWTP can cause a total "kill" of the system or severely damage the ability of the bacteria to remove organic/inorganic contaminates. Bacteria will have to be replaced to get the plant in working order. This may take several weeks for the biological treatment plant to return to normal.

Changes can be made in the composition, operation and arrangement of the method of the invention described herein without departing from the concept and scope of the invention as defined in the claims.

The invention claimed is:

1. A method of removing metal ions from hydrocarbon feedstocks comprising (i) mixing the feedstocks with an effective metal removing amount of an aqueous solution of one or more water-soluble poly(acrylic acid) derivatives selected from the group consisting of copolymers of (meth)acrylic acid or a salt thereof and one or more monomers selected from dimethylaminoethylacrylate quaternary salt and diallyldimethylammonium chloride to form an aqueous phase containing the metal ions and a hydrocarbon phase; and (ii) separating the hydrocarbon phase from the aqueous phase.

2. The method of claim 1 wherein the metal ions are selected from the group consisting of +2 and +3 ionically charged metals.

3. The method of claim 2 wherein the poly(acrylic acid) derivative has a molecular weight of about 100 to about 4,000,000.

4. The method of claim 3 wherein the +2 and +3 ionically charged metals are selected from zinc, iron, cobalt, copper, magnesium, manganese and calcium.

5. The method of claim 3 wherein the ionically charged metals are selected from the group consisting of +2 ionically charged metals.

6. The method of claim 5 wherein the +2 ionically charged metal is calcium.

7. The method of claim 6 wherein the poly(acrylic acid) derivative has a molecular weight of about 2,000 to about 8,000.

8. The method of claim 1 wherein the separating is performed by conventional desalting processes or by countercurrent extraction.

9. The method of claim 1 wherein the hydrocarbon feedstocks are selected from the group consisting of crude oil, heavy hydrocarbonaceous residua, solvent deasphalted oils derived from the crude oil or residua, shale oil, liquified coal and tar sand effluent.

10. The method of claim 1 wherein the hydrocarbon feedstock is crude oil.

11. The method of claim 3 wherein the poly acrylic acid derivative is acrylic acid-dimethylaminoethylacrylate methyl chloride quatemary salt copolymer.

* * * * *